United States Patent [19]

Dubak et al.

[11] Patent Number: 4,872,095

[45] Date of Patent: Oct. 3, 1989

[54] ENTRANCE DOOR NIGHT LIGHT

[76] Inventors: Glenda A. Dubak; Peter D. Capizzo, both of 76376 Romeo Plank Rd., Romeo, Mich. 48065

[21] Appl. No.: 165,125

[22] Filed: Mar. 7, 1988

Related U.S. Application Data

[63] Continuation-in-part of Ser. No. 867,206, May 27, 1986, Pat. No. 4,757,430.

[51] Int. Cl.[4] ..... E05B 17/10

[52] U.S. Cl. ..... 362/100; 362/155; 362/802

[58] Field of Search ..... 362/100, 116, 154, 155, 362/276, 253, 190, 191, 157, 802

[56] References Cited

U.S. PATENT DOCUMENTS 3,590,234 6/1971 Bartick ..... 362/802
3,787,677 1/1974 Molitor ..... 362/100
3,965,465 6/1976 Alexander ..... 362/802
4,475,067 10/1984 Rowe ..... 362/100

FOREIGN PATENT DOCUMENTS 2083719 3/1982 United Kingdom ..... 362/191

*Primary Examiner*—Ira S. Lazarus
*Assistant Examiner*—Sue Hagarman

[57] ABSTRACT

An entrance door night-light contained within an enclosure that is mounted to the head of an entrance doorway between the storm door and the entrance door. The enclosure is positioned to project light onto the door-handle and lockset area. The enclosure contains a lamp, powered by a DC voltage source, a momentary switch that makes contact with the storm door and is used to switch the lamp on when the storm door is opened, a timer to turn the light off if the storm door does not close, and a photocell to keep the lamp off during daylight, even when the storm door is open.

1 Claim, 5 Drawing Sheets

ENTRANCE DOOR NIGHT LIGHT

This is a continuation-in-part of patent application Ser. No. 06/867,206 filed May 27, 1986 now U.S. Pat. No. 4,757,430.

BACKGROUND

This invention relates to a battery operated entrance door night-light. It is an object of this invention to provide lighting while entering or leaving and, more particularly, locking or unlocking an entrance doorway, by utilizing the storm door, a timer, and a photocell to turn the light on and off.

Presently, there are a few alternative methods of lighting entranceways. One is using the building or premise lighting (i.e. porchlights). The disadvantage of this is that the light must be turned on when leaving the premises, and must remain on until a person returns and turns the light off. In this case, energy is wasted. Also, departure often occurs during daylight, and the light is not turned on, but arrival is at night when the light is needed.

Another method of lighting is to use a portable penlight. The disadvantage of a penlight is that it is cumbersome to work both the light and the key at the same time. Also, the penlight is bulky and uncomfortable to carry.

SUMMARY OF THE INVENTION

What the present invention provides is an inexpensive, energy efficient, long life, carefree lighting while using an entrance doorway.

The present invention consist of a small enclosure which contains: a DC voltage source for circuit control, a DC voltage source for lamp power, an incandescent lamp for lighting, a normally closed momentary switch operated by the storm door, a timing circuit to turn off the light if the storm door does not close, and a photocell and circuitry for nighttime operation.

The enclosure is small enough to be mounted between the storm door and the entrance door, onto the head of the door frame, by means of mounting devices such as screws. The enclosure is positioned to hang over the door handle and lockset so that the momentary switch is facing the storm door and will make contact with the storm door when it is closed. The enclosure is also symetrical so that it can be hung over a right handed or left handed door.

Functionally, the present invention operates as follows: during darkness when the storm door is opened, the switch closes causing the light to go on and stay on until the storm door is closed, making contact with the switch again, causing the switch to open and consequently turning the light off. If the storm door does not close, the timing circuit will automatically turn the light off after a predetermined time delay. The photocell is used to keep the light from going on during daylight even when the storm door is open.

From the above scenario, it is seen that the light therefore will be on only for the few seconds it takes to enter a doorway, therefore saving energy and prolonging the life of the batteries.

The present invention is convenient and carefree. It is mounted high and out of the way and operates by the simple action of entering or leaving a doorway.

Also, the present invention is a self-contained unit that requires no wiring changes or devices added to existing lighting systems, therefore making it inexpensive and easy to install.

This invention also provides a door night light with a time delay circuit. The photocell in the system of this invention keeps the light off during daylight hours thus conserving the battery energy. However, if the screen or storm door does not close or is ajar, the light will remain on at night, or leakage current through the photocell will occur during the day, significantly reducing the life of the batteries, and therefore reducing the practicality of a battery operated door night light.

What the present invention proposes is to utilize an electronic timing circuit to break the electrical circuit of the lighting system. An advantage of using a timer is that it is internal to the device and will automatically shut off the light at night if the door does not close. An additional advantage is that the leakage current through the photocell will be stopped after the timer has timed out.

Also the present invention provides a selector switch working in cooperation with the timing circuit, giving the operator a choice of having the door light work automatically, on continuously or off permanently.

Also the present invention provides a magnetically operated switch for sensing the proximity of the screen or storm door in lieu of a mechanical switch. The magnetic switch is actuated by a magnet attached to the screen or storm door.

When using a mechanical push-button switch, precise adjustment is required to assure the switch is actuated when the screen or storm door is closed. Also if the screen or storm door is ajar, the switch will not be actuated, keeping the light on. The advantage of using a magnetically operated switch is that precise adjustment is unnecessary and if the screen or storm door is slightly ajar the switch will still be actuated.

DESCRIPTION OF THE PREFERRED EMBODIMENT

Figure 1:
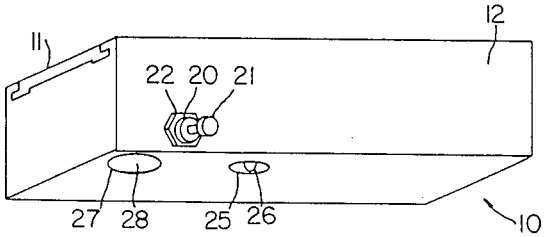
FIG. 1 is a perspective view of the housing of the invention looking at the bottom, left and front sides.

Referring to FIGS. 1–5, there is shown the device 10 comprising a top cover 11 and a rectangular housing 12 with slots 13 used to slide housing 12 horizontally onto the top cover 11. The slots 13 are opened at both ends of the housing 12 so that the housing 12 can be slid on and off the top cover 11 at either end. This feature of the invention is useful for the installation of the device which is explained as follows: the top cover 11 is first secured to the head of the door frame (on the side over the doorhandle and lockset) with mounting screws 14 through mounting holes 15. The housing 12 is then slid onto the top cover 11 which holds the housing 12 in place.

The housing 12 contains three openings: the switch opening 20 for the momentary switch 21 secured in place by the retaining nut 22, the light opening 25 for the light bulb 26, and the photocell opening 27 for the photocell 28.

Figure 2:
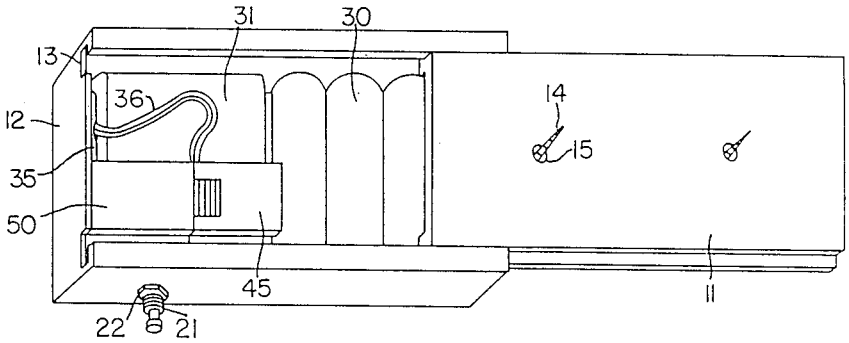
FIG. 2 is a perspective view of the housing of the invention looking at the top with the top cover partially removed.
Figure 3:
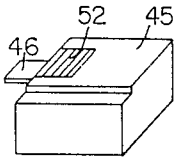
FIG. 3 is a perspective view of the light bulb cover of the device.
Figure 4:
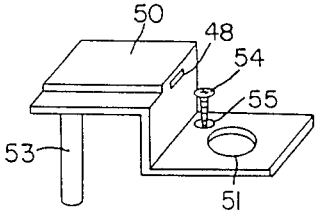
FIG. 4 is a perspective view of the circuit cover of the device.
Figure 5:
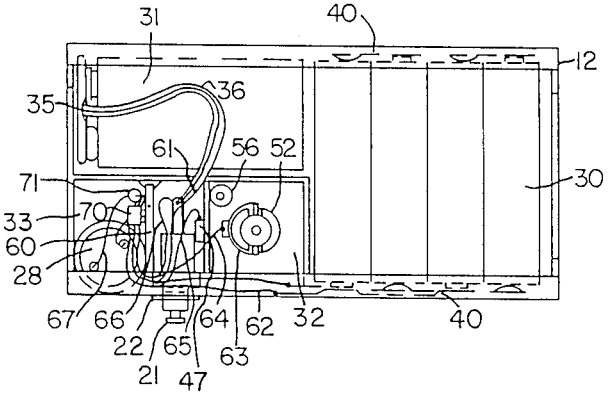
FIG. 5 is a plane view of the invention with all three covers removed to reveal the inner parts of the device.

Turning now to FIG. 2, the interior of the housing 12, there is space for four 1.5 volt AA cell batteries 30 aligned side by side (interconnected for a 3 volt source), a 9 volt battery 31, a light bulb compartment 32, and a circuit compartment 33 (shown with all covers removed in FIG. 5). FIG. 2 shows the preferred arrangement of the batteries 30 and 31, and compartments 32 and 33 within the housing 12. The 9 volt battery 31 is connected to the circuit by a common 9 volt terminal strap 35 with several inches of lead wires 36 which allow the 9 volt battery 31 to be removed without disconnecting it. With the 9 volt battery 31 removed it is then easy to remove the AA cell batteries 30 by inserting a finger where the 9 volt battery 31 was and prying the AA cells 30 loose from their terminal clips 40.

Covering the light bulb compartment 32 is a light cover 45 with a positive terminal post 46 attached to the upper underside of the cover 45. The terminal post 46 makes contact with the light bulb cathode tip and plugs into the positive light bulb socket 47 through an opening 48 in the circuit cover 50 when the light cover 45 is in place. Molded into the top of the light cover 45 is a set of friction grooves 52 used when sliding the light cover 45 on and off the light bulb compartment 32.

Covering the circuit compartment 33 is a circuit cover 50. The circuit cover 50 has an opening 51 for the light bulb 26 which is placed by inserting it through the opening 51 and into the lightbulb retainer 52 which is in the circuit compartment 33. Also, as previously mentioned, there is an opening 48 for the positive terminal post 46 attached to the light bulb cover 45. Attached to the underside of the circuit cover 50 is the photocell retaining post 53 used to keep the photocell 28 in the photocell opening 27. The circuit cover 50 is secured by placing the circuit cover retaining screw 54 through the screw opening 55 into a screw retaining post 56.

Turning now to FIG. 5, the placement and interconnection of the different components of the circuit are shown. As previously mentioned, the 9 volt battery 31 lays loosely in the housing 12 and is connected with a terminal strap 35 to the circuit board 60 and the momentary switch 21 by lead wires 36 which run through an opening 61 in the side of the circuit compartment 33. Four terminal clips connect the AA cell batteries 40 to the circuit board 60 by lead wires 62. The light bulb 26 is held in place by the light bulb retainer 52 which also holds the light bulb negative terminal clip 63 which is connected to the circuit board 60 by lead wire 64. As previously mentioned, the light bulb positive terminal post 46 plugs into the light bulb socket 47 which is connected to the circuit board 60 by lead wire 65. The momentary switch 21 is connected to the 9 volt battery 31 by lead wire 36 and to the circuit board by lead wire 66. The photocell 28 is connected to the circuit board by leads 67. On the circuit board 60 is attached a transistor 70 and a resistor 71.

Figure 6:
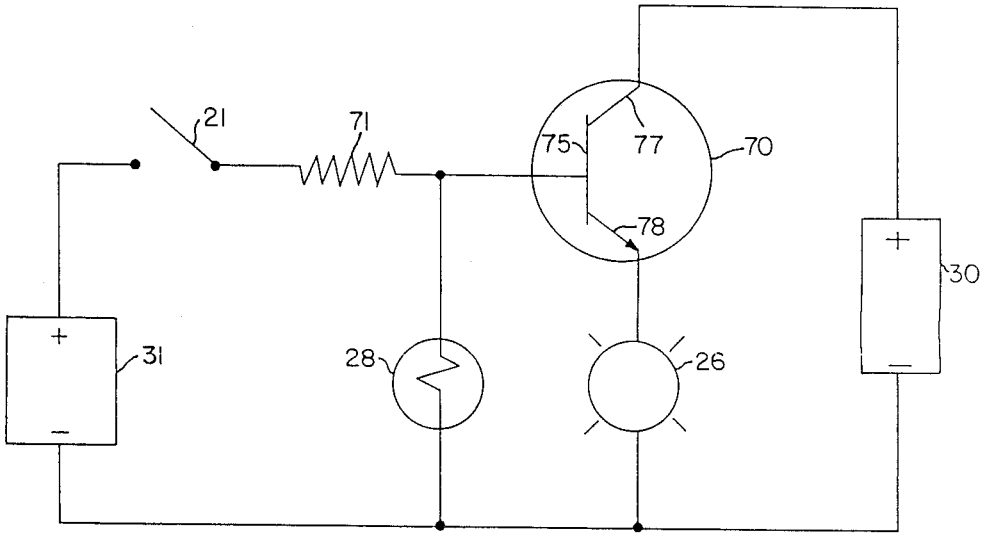
FIG. 6 is a schematic diagram of the circuit of the invention.

Turning now to FIG. 6, the operation of the circuit is shown. The 9 volt DC voltage source 31 is utilized to forward bias the transistor 70 into the on or conducting state. The resistor 71 is connected in series with the voltage source 31 and reduces the voltage to an optimal level at the transistor base 75 for forward biasing. The photocell 28 is connected between the base 75 and the source return 76 (referred to as ground). The resistance of the photocell is controlled by the level of ambient light intensity. The higher the ambient light intensity the lower the resistance. During daylight, the photocell 28 acts effectively as a short between the base 75 and ground 76. Therefore, the transistor 70 cannot be forward biased to an on state during daylight (or when there is sufficient level of ambient light i.e. that produced by a porchlight). But during periods of darkness, the resistance of the photocell 28 is increased so that it will effectively act as an open circuit between the base 75 and ground 76. Then the voltage level at the base 75 will be determined by resistor 71 value and the equivalent impedance of the transistor and light bulb acting as a voltage divider. The value of the resistor is selected to bias the transistor on when the photocell 28 is in an open circuit state. When photocell 28 is in a short circuit state, the resistor 71 will act as a leakage current limiter. Leakage current from the 9 volt source 31 will occur only during periods of both daylight and door open (switch 21 closed) conditions, and will be small enough not to effect the overall life of the source 31. This arrangement is preferred so that the light bulb 26 will not come on, draining the 3 volt source 30, at unnecesary times, greatly reducing the life of the 3 volt source.

When the transistor 70 is biased on, the 3 volt source 30 (preferrably consisting of 4 AA cell batteries arranged in two sets of two in series for long life of the device), connected to the transistor collector 77, will drive a current, sufficient to power on the light bulb 26. The light bulb 26 is connected between the transistor emitter 78 and ground 76.

In series with the 9 volt source 31 is a normally closed momentary switch 21 connected between the source 31 and the resistor 71. The switch is used to turn the biasing current on and off, when the storm door is opened or closed respectively.

Figure 7:
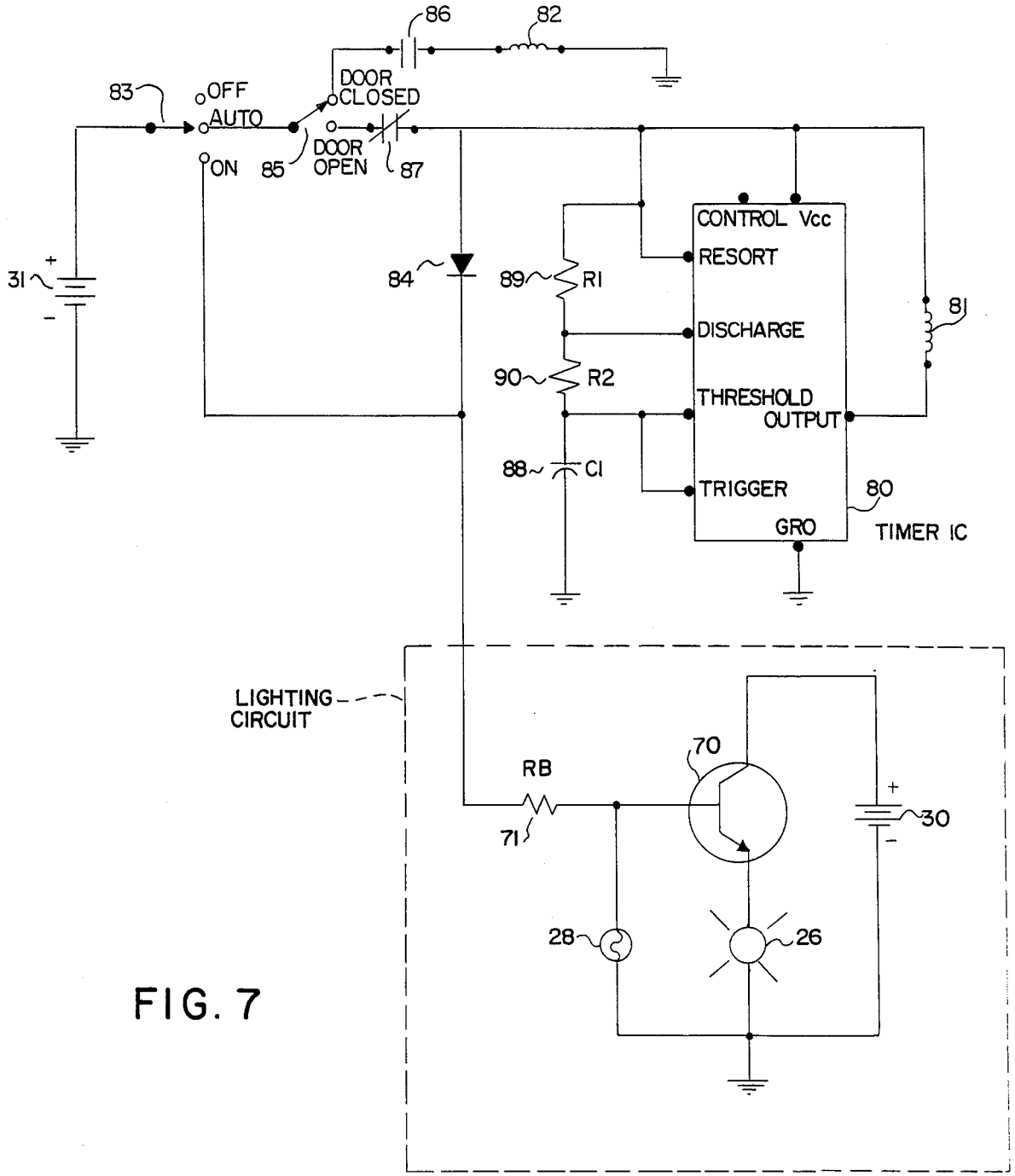
FIG. 7 shows the use of a 555 IC timer and an electromagnetic latching relay to form a functional timing circuit.

Turning now to FIG. 7, a time delay circuit is shown coupled to a lighting circuit. The time delay circuit consist of a standard 555 integrated circuit timer 80, and working in cooperation with the timer 80, a dual coil DPDT set, reset, latching relay. The contacts of the relay are set by energizing coil 81, and without power, will remain set until the reset coil 82 is energized. A three position switch 83 is connected to the circuit to provide three operational modes of the timing circuit. One is the OFF mode in which the electrical circuit is broken so that no power from the voltage source 31 is available under any condition. The second mode of operation is the ON mode, in which the voltage source 31 is connected directly to the lighting circuit. A diode 84 is used to block current from going into and energizing the timing circuit, which would be a waste of energy in this mode.

The third mode of operation selected by the switch 83 is the AUTOMATIC timing mode. In the AUTOMATIC mode the voltage source 31 is connected directly to the screen-door actuated switch 85. Switch 85 is a SPDT momentary switch.

A timing sequence in the AUTOMATIC mode will occur as follows:

Initially, the screen door is in the closed position, causing switch 85 to open, thereby connecting the voltage source 31 to contacts 86. Contacts 86 are open, preventing any energy to coil 82. Contacts 87 are closed. Discharge of the timer 80 is grounded, causing threshold, trigger and reset potentials to be grounded, and capacitor 88 to be discharged. The control function of the timer 80 is not used and is unconnected. The output of the timer 80 is low and the system is in an inactive state with absolutely no leakage current.

Once the screen door is opened, switch 85 closes, connecting the voltage source 31 to contacts 87 which are still closed, causing the timer 80 and lighting circuit to be energized. Since trigger is initially low, the output of the timer 80 will go high, and since the response time of coil 81 is much greater than that of the timer 80 output, coil 81 will be prevented from energizing. The threshold and trigger potentials will now gradually rise at a rate dependent on the RC network consisting of resistor 89, resistor 90 and capacitor 88. When the threshold potential reaches its rated level (typically $\frac{2}{3}$ Vcc) the output of the timer 80 will go low, causing coil 81 to be energized. As coil 81 is energized, contacts 86 close and 87 open. As contacts 87 open the voltage source 31 is disconnected from the timing and lighting circuits, and the timer 80 goes back to its initial condition, discharging capacitor 88.

The timing circuit remains in this state until the screen door is closed again, causing switch 85 to open, thereby connecting the voltage source 31 to contacts 86 again. But contacts 86 are closed and coil 82 will be energized. As coil 82 is energized contacts 86 open and 87 close. As contacts 86 open energy to coil 82 is disconnected and the system is now back in the initial condition with no leakage current.

Figure 8:
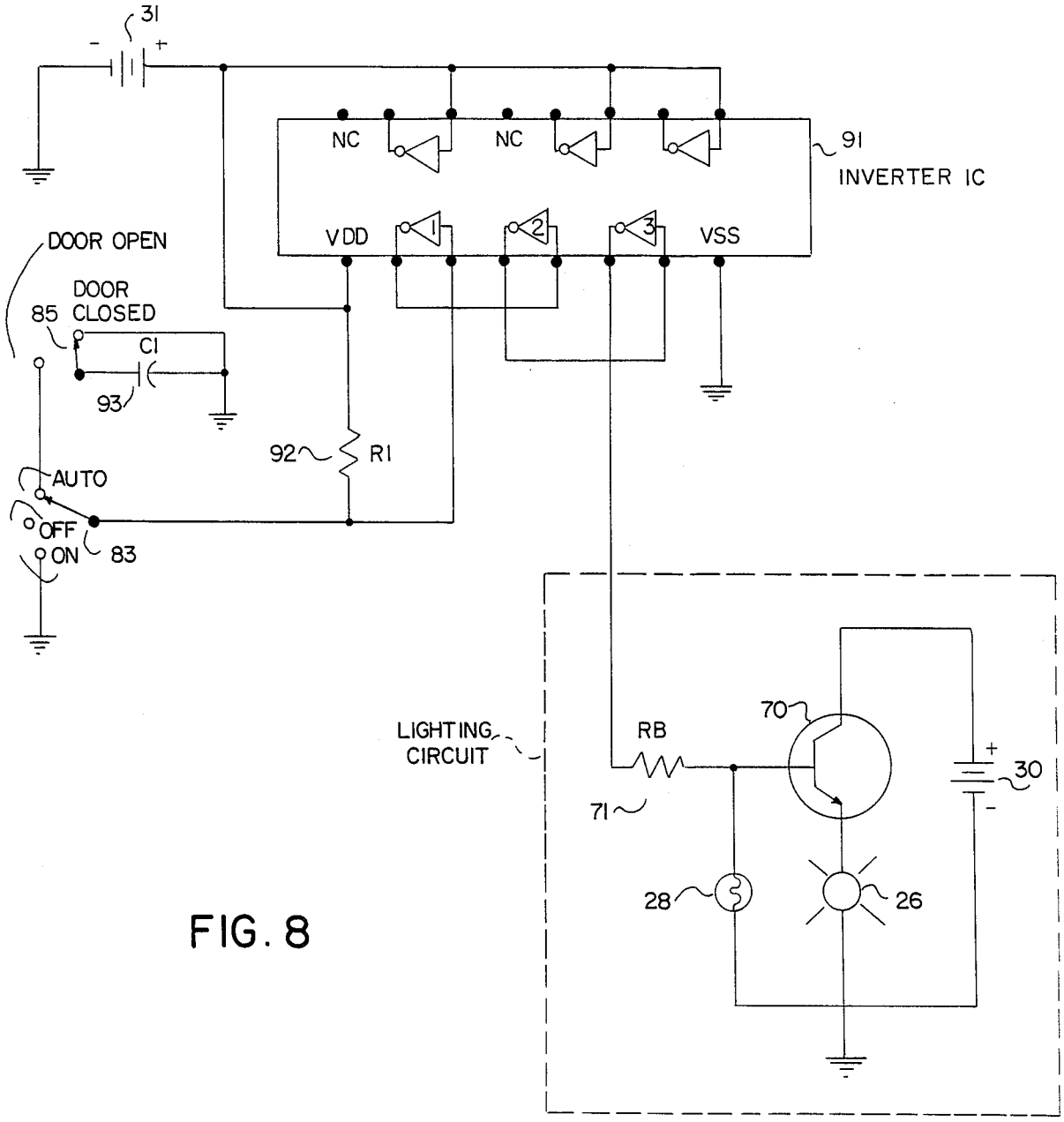
FIG. 8 shows the use of an inverting IC for a timing circuit.

Turning now to FIG. 8, a time delay circuit is shown coupled to a lighting circuit where a standard 4069 integrated circuit Hex Inverter 91 is utilized. The inverter chip voltage supply VDD is connected directly to the voltage source 31 and the ground of the chip VSS is connected directly to ground. Three inverters are connected in series to increase the switching action of the RC timing network to an acceptable speed. If a single inverter were used, a dimming effect of the light 26 would occur as the inverter output changed from a high to low state. The input to inverter 1 is connected to a three-position switch 83. The output of inverter 3 is connected directly to the lighting circuit. The remaining three inverters of the chip are unused and the inputs are connected to the voltage source 31 to hold the output low. Again the three position switch 83 is used to provide three modes of operation. The OFF mode in which the input to inverter 1 will go high through resistor 92, causing the output of inverter 3 to go low, keeping the lighting circuit off. The ON mode in which the input to inverter 1 is grounded, causing the output of inverter 3 to go high and drive the lighting circuit on. Finally, the AUTOMATIC mode in which the input of inverter 1 is connected to the door actuated switch 85.

A timing sequence in the AUTOMATIC mode will occur as follows;

Initially the screen door is closed, causing switch 85 to open, thereby connecting capacitor 93 to ground. The input potential at inverter 1 is driven high by the voltage source 31 through resistor 92. The output of inverter 1 is low and is the input to inverter 2. The output of inverter 2 is high and is the input to inverter 3. The output of inverter 3 is low and is connected to the lighting circuit. The lighting circuit is therefore held off.

When the screen door is opened, switch 85 closes, connecting the input of inverter 1 to capacitor 93 an therefore dropping the input to inverter 1 low. The output of inverter 1 goes high and is the input to inverter 2. The output of inverter 2 goes low and is the input to inverter 3. The output of inverter 3 goes high and drives the lighting circuit on.

Capacitor 93 begins to charge up at a rate dependent on the RC network of resistor 92 and capacitor 93. When the potential at the input of inverter 1 reaches the rated high level, the output of inverter 1 switches from a high state to a low state, causing the output of inverter 3 to go low and de-energize the light circuit.

When the screen door is closed again, switch 85 opens, discharging capacitor 93, and the timing circuit is back in the initial condition.

Figure 9:
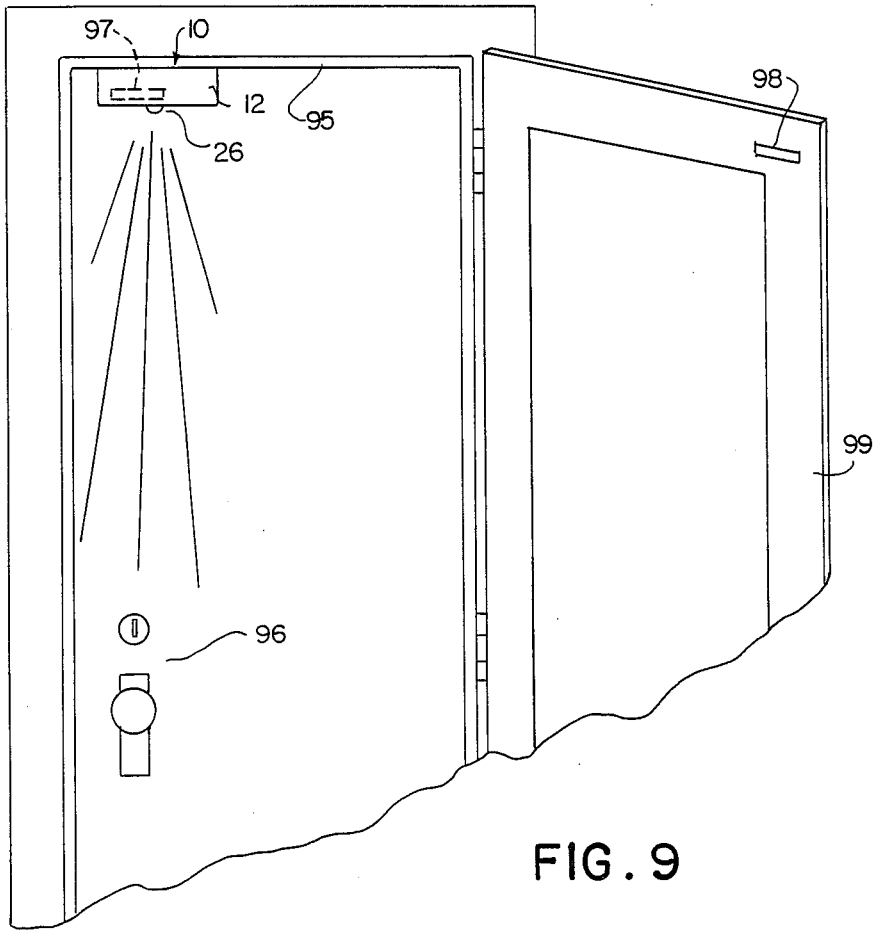
FIG. 9 is a perspective view of the invention utilizing a magnetically operated door switch.

Finally in FIG. 9, the invention 10 is shown attached to the head of a door frame 95, projecting light onto the door lockset area 96. A magnetically operated door switch 97, shown by broken lines, is inside the housing 12. A magnet 98 is attached to the screen or storm door 99, so that when the screen or storm door is opened the switch 97 will turn on causing the light 26 to go on, and when the screen or storm door 99 is closed the switch 99 will turn off, causing the light 26 to go off.

In summary, the light will come on only when the door is opened during darkness. During daylight, the photocell will short the biasing current to keep the light off, even if the door is open. The addition of a timing circuit will turn off the light at night or prevent photocell leakage in daylight if the door does not close. This arrangement insures a long life of the batteries and reduces the inconvenience and expense of replacing the batteries.

Typical component values are as follows:

| | |
|---|---|
| FIG. 6 | |
| Resistor | Kilohms 2.0 |
| Transitor | NPN 2N4401 |
| Photocell | Maximum Resistance 100 Kilohms<br>Minimum Resistance 250 Ohms. |
| FIG. 7 | |
| Resistor RB | Kilohms 1.0 |
| Resistor R1 | Megaohms 5.0 |
| Resistor R2 | Kilohms 1.0 |
| Capacitor C1 | Microfarads 10.0 |
| IC Timer | LM555 |
| Relay | Latching DPDT 2 Amp |
| FIG. 8 | |
| Resistor RB | Kilohms 2.2 |
| Resistor R1 | Megaohms 10.0 |
| Capacitor C1 | Microfarads 4.7 |
| IC Invertr | MC14049 |

The present invention is well adapted to carry out the object and attain the ends and advantages mentioned, as well as other inherent therein. While a presently preferred embodiment is given for the purpose of disclosure, numerous changes in the details of construction and arrangement of parts can be made, which will readily suggest themselves to those skilled in the art, and which are encompassed within the spirit of the invention and the scope of the appended claims.

I claim:

1. A night light for attachment between an entrance door having a lock set and an adjacent screen door, said night light comprising:

an enclosure for mounting between the entrance door and the adjacent screen door, said enclosure having a plurality of openings formed therein;

a DC voltage source means mounted within said enclosure;

a first switch affixed to said enclosure adjacent one of said openings for sensing the proximity of the screen door;

a light source affixed to said enclosure adjacent one of said openings for directing light upon the lock set;

a light sensor for detecting ambient light level, said light sensor affixed to said enclosure adjacent one of the openings formed therein;

a second switch, responsive to said light sensor, being closed at low ambient light levels, and open at high ambient light levels, said second switch connecting said light source to said voltage source means;

a time delay means comprising a RC timing circuit and a plurality of inverters connected serially with each other, said RC timing circuit being connected to said voltage source means by said first switch, said RC timing circuit and said first switch being coupled with the input of the first inverter for changing the polarity of the output of the last inverter, which is coupled to said second switch, after a predetermined time delay that is initiated by closing said first switch;

whereby said DC voltage source means, light source, first switch, second switch, light sensor, and time delay means are electrically connected so that when the screen door is open, thereby closing the first switch, and the ambient light level is low enough to thereby cause the second switch to close, the electrical circuit will be completed causing the light source to illuminate the lock set, and when the ambient light level is high enough to cause the second switch to open, the electrical circuit will be broken, thereby preventing the light source from illuminating the lock set, and if the said screen door does not close before the predetermined time delay elapses, then the timing means will cause the second switch to open, thereby breaking the electrical circuit and extinguishing the light source.

* * * * *